United States Patent [19]

Astier

[11] 4,438,303

[45] Mar. 20, 1984

[54] ASSEMBLY FORMING INTERFITTING SOCKET AND PLUG FOR CONNECTION TO A CIRCUIT IN WHICH THE SOCKET IS MOUNTED, WITHOUT THE CIRCUIT OPENING

[76] Inventor: Louis Astier, 51 avenue du Général de Gaulle, Meudon la Foret, France, 92360

[21] Appl. No.: 253,398

[22] Filed: Apr. 13, 1981

[30] Foreign Application Priority Data

Apr. 14, 1980 [FR] France ..... 80 08280

[51] Int. Cl.[3] ..... H01H 27/00

[52] U.S. Cl. ..... 200/51.1; 200/51.11; 200/275; 339/184 M; 339/31 T

[58] Field of Search ..... 200/51.1, 51.11, 51.09, 200/275; 339/31 T, 31 M, 19, 65, 66 R, 66 M, 184 R, 184 M

[56] References Cited

U.S. PATENT DOCUMENTS

| | | | |
|---|---|---|---|
| 1,825,208 | 9/1931 | Rumble | 200/51.1 |
| 2,184,840 | 12/1939 | Johansson et al. | 200/51.10 |
| 3,015,083 | 12/1961 | Juris | 339/186 M |
| 3,090,948 | 5/1963 | Cremer | 200/51.10 |
| 3,225,155 | 12/1965 | Duncan | 200/51.09 |
| 3,371,167 | 2/1968 | Soulakis, Jr. | 200/275 X |
| 3,930,705 | 1/1976 | Gallagher | 339/184 MX |
| 4,038,505 | 7/1977 | Gasparaitis et al. | 200/51.10 |
| 4,082,928 | 4/1978 | Andresen | 200/275 X |
| 4,196,325 | 4/1980 | Povilaitis | 200/275 X |

FOREIGN PATENT DOCUMENTS

| | | | |
|---|---|---|---|
| 691333 | 4/1940 | Fed. Rep. of Germany . | |
| 1802457 | 11/1969 | Fed. Rep. of Germany . | |
| 1613706 | 5/1971 | Fed. Rep. of Germany | 200/51.1 |
| 2023857 | 8/1970 | France . | |
| 2175351 | 10/1973 | France . | |

*Primary Examiner*—John W. Shepperd
*Assistant Examiner*—Renee S. Kidorf
*Attorney, Agent, or Firm*—Bacon & Thomas

[57] ABSTRACT

The present invention relates to an assembly forming interfitting socket and plug for connection to a circuit in which the socket is mounted, without the circuit opening. The socket comprises a housing at the bottom of which is housed a switch of the pressure type returned to position of closure by an elastic blade and two first branch contact elements projecting on two sides of the housing; the plug is guided between these sides and has a wide push element which is provided laterally with second branch contact elements coming into contact with the first ones before the end of the push element opens the switch by pushing the elastic blade, so that the continuity of the circuit in which the socket is mounted is preserved when the plug is connected or disconnected.

9 Claims, 2 Drawing Figures

ASSEMBLY FORMING INTERFITTING SOCKET AND PLUG FOR CONNECTION TO A CIRCUIT IN WHICH THE SOCKET IS MOUNTED, WITHOUT THE CIRCUIT OPENING

The present invention relates to an assembly forming interfitting socket and plug for connection to a circuit in which the socket is mounted, without the circuit opening.

More particularly, the present invention relates to an assembly of this type in which:

the socket comprises an outwardly open housing: a switch adapted to be mounted in series on the circuit, disposed near the bottom of the housing and returned into position of closure by an elastic return force; and two first branch contact elements connected respectively to the terminals of the switch, and the plug comprises an actuation element opening the switch against the elastic return force when the plug is inserted in the housing, and two second branch contact elements, each coming into contact with a respective first branch contact element for a penetration of the plug less than that necessary for opening the switch, the plug thus being connected in shunt to the terminals of the switch, or disconnected, without the circuit opening.

A particular field of application of the invention is that of measurements to be made on a secondary winding of a current transformer, for example in the case of faults. In this case, the socket is permanently mounted on the secondary winding of the current transformer, the switch normally being closed. A current measuring apparatus may then be connected in series on the secondary winding by means of the plug, without the secondary winding being open at any moment, which would be detrimental to the current transformer.

Devices forming socket and plug of the type defined hereinabove are well known in the art. However, these devices have not always proved to be suitable for the application envisaged hereinabove, particularly when the plugs are manipulated without particular precautions and with a certain haste—as in the case of measuring intensity consecutive to the appearance of a fault—and when the current circulates with a relatively high intensity at a low voltage. In fact, the actuation element is often made in the form of a finger or rod of insulating material to push a bar-shaped piece which normally short circuits two fixed contacts of the switch, being returned into position of closure by a spring. Drawbacks of such arrangements include a certain fragility of the actuation element, a rapid deterioration of the contacts of the switch when the shapes of the bar and of the terminals of the switch are such that they are only in linear or punctual contact, and the necessity of using a spring which may pose problems of assembly and calibration. In certain cases, the branch contacts are of the pin and socket type and their quality is such as to deteriorate in time.

It is an object of the present invention to provide a robust assembly adapted to be manipulated without particular precaution, with reliable contacts and of constant quality both for the switch of the the socket and for the branch contacts, in order to avoid, in the case of application to a secondary winding of a current transformer operating at low voltage, any deterioration of the transformer due to poor contacts. It is also an object of the present invention to combine these advantages with a structure which is as simple and inexpensive as possible.

These purposes are attained in that, according to the invention:

the switch is constituted by two contact elements of which at least one is borne by an elastic blade and which form a contact by pressure, and the plug is guided between two opposite sides of the housing of the socket, on which sides are located said first branch contact elements and the actuation element forms a push element occupying virtually the whole width of the housing and bearing the second branch contact elements on two opposite sides so that each pair constituted by a corresponding first and second branch contact element forms a sliding contact.

The robustness and simplicity of the device according to the invention come from using a wide push element bearing the second branch contact elements and from the absence of return springs.

The quality of the contacts results from the choice, for the switch, of a pressure contact, with contact elements such as pellets, of which one is borne by a flexible blade, and, for the branches, of sliding contacts.

The invention will be more readily understood on reading the following description with reference to the accompanying drawings, in which.

Figure 1:
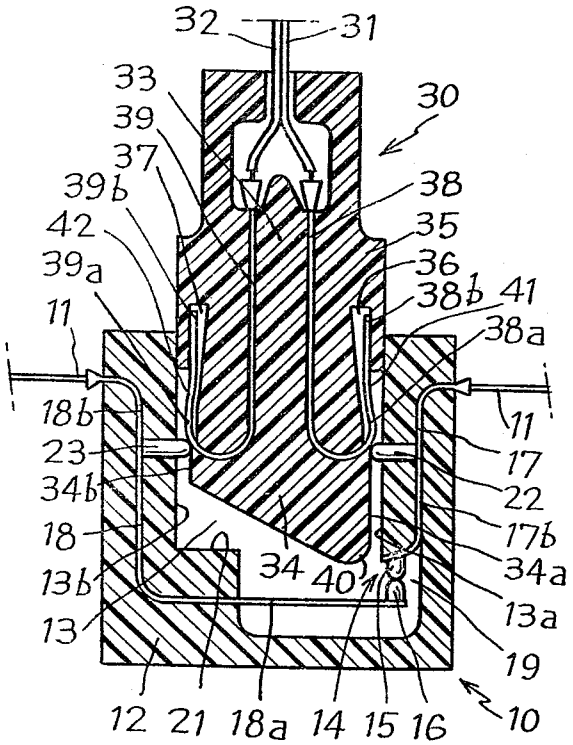
FIG. 1 is a schematic view in section of an embodiment of an assembly according to the invention.

Referring now to the drawings, the assembly shown in FIG. 1 comprises a socket 10 mounted on a circuit 11, for example the secondary winding of a current transformer (not shown) and a plug 30 connected by conductors 31, 32 to a measuring apparatus, for example an ammeter (not shown).

The terminal 10 comprises a body 12 made of insulating material for example obtained by moulding a synthetic resin. An outwardly opening housing 13 is formed in the body 12.

Near the bottom of the housing 13 is disposed a switch 14 comprising two contact elements 15, 16 fixed to the ends of conducting blades 17,18. The contact elements 15, 16 are preferably silver-plated pellets welded on the blades 17, 18. The blade 17 is embedded in the insulating material except for its end bearing pellet 15. The blade 18 is embedded in the insulating material of the body 12 except for the section 18*a* located towards the end bearing the pellet 16. At their other ends, the blades 17, 18 project from the body 12, for connection to the circuit 11.

As may be seen in FIG. 1, the contact elements 15, 16 are housed in a recess 19 formed on the sides 13*a* of the housing 13. On the side 13*b* opposite the recess 19 is provided a shoulder 21 from which the section 18*a* of the blade 18 projects substantially parallel to the bottom of the housing 13 and near same. The section 18*a* forms an elastic blade applying, with pressure, the contact element 16 against the contact element 15.

The blades 17, 18 are bent and have parts 17*b*, 18*b* which extend substantially parallel to the sides 13*a*, 13*b* of the housing 13, in the material of the body 12. On these parts 17*b*, 18*b* are welded silver-plated pellets 22, 23 forming first branch contact elements, projecting in the housing 13 on its opposite sides 13*a*, 13*b*. As a variant, as shown in FIG. 2, the contact elements 22, 23 may advantageously be formed by bent parts of the blades 17, 18 projecting from the material constituting the body 12 into the housing 13 on either side 13*a*, 13*b* thereof.

The plug 30 comprises a body 33, likewise made of insulating material, of which the front part 34 forms push element of width slightly smaller than that of the housing 13 and of which the rear part 35 has a width substantially equal to that of the housing 13. Where the parts 34 and 35 of the body join, on each side thereof, grooves 36 and 37 are formed. Metal blades 38, 39 are partially embedded in the body 33. At one of their ends, the blades 38, 39 are electrically connected to the conductors 31, 32 at the rear of the plug 30. At their other ends, the blades 38, 39 present parts 38*a*, 39*a* which project on two opposite sides 34*a*, 34*b* of the push member 34 and are bent rearwardly with respect to the plug, with their ends 38*b*, 39*b* housed in the grooves 36, 37. Thus, parts 38*a*, 39*a* forming second branch contact elements are maintained in position against the stress which tends to separate them laterally from the push member 34.

At its end, the push element 34 is dissymmetrical and has an inclined front edge with an apex 40 located in the vicinity of side 34*a*.

Figure 2:
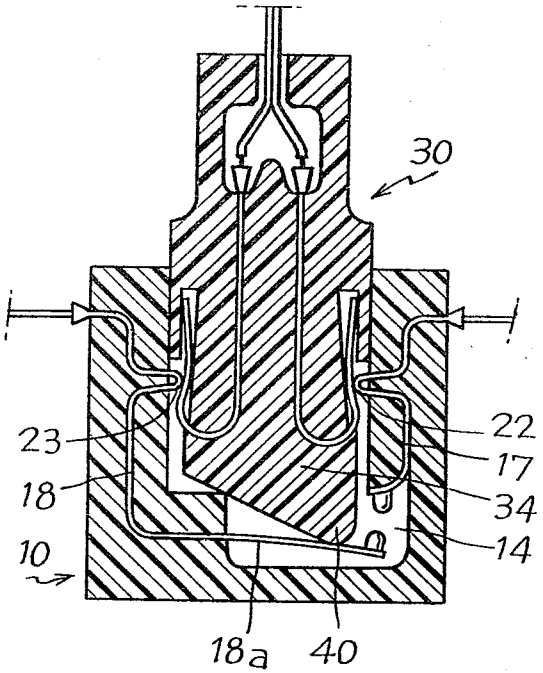
FIG. 2 shows a variant embodiment of the socket of the assembly illustrated in FIG. 1.

The functioning of the assembly shown in FIG. 1 or FIG. 2 readily follows from the foregoing description.

The plug 30 being withdrawn, the switch 14 is closed and ensures continuity of the circuit 11.

When the plug 30 is introduced into the housing, 13, it is guided by its rear part 35 sliding between the sides 13*a*, 13*b*. The blades 38, 39 come into contact with the elements 22, 23 before the end 40 of the push element touches the elastic blade 18*a* (FIG. 1). The elements 22, 23 slightly push the parts 38*a*, 39*a* and constitute therewith two branch contacts of the sliding and pressure type, due to the stress to which the bent parts 38*a*, 39*a* of the blades 38, 39 are subjected.

The insertion of the plug 30 being continued, the apex 40 comes into contact with the elastic blades 18*a* near the switch. As the elastic blade extends transversely with respect to the direction of insertion of the plug, it is pushed by the push element 34. At the end of stroke of the plug 30 (FIG. 2), the switch 14 is open and the contact elements 22, 23 are at the level of notches 41, 42 formed on the blades 38, 39 to ensure that the plug 30 is held in the socket 10.

When the plug 30 is withdrawn, the switch 14 closes before the branch contacts are open. Any opening of the circuit 30 is thus avoided both during connection and during disconnection of the plug 30.

It will be noted that, whilst the plug 30 is being withdrawn, the flexible blade 18*a* and the blade parts 17*b*, 18*b* form a U which constitutes part of a loop which is closed by the branch contacts and has for effect to promote the return of the flexible blade 18*a* into position of closure. At the moment of this return, between the instant when the contact pellets touch and that when the contact pressure is definitive, the flexible blade 18*a*, under the effect of its tension, passes from a rectilinear form to the form of an arc and the substantially spherical contact pellets roll on each other, which has for effect automatically to clean the contacts of the switch 14. The branch contacts are also self-cleaning since they are sliding contacts.

It will further be noted that the shoulder 21 forms a stop against which the corner 40 abuts, without being able to open the switch 14, when the plug is in a turned position with respect to its normal position.

In place of the shoulder 21, or in addition to it, a stop means may be formed by giving the rear part of the plug and the inlet of the housing of the socket corresponding dissymmetrical forms allowing complete insertion of the plug only if the latter is in the correct position.

In addition to its robustness and the reliability of its contacts, it will finally be noted that the assembly according to the invention is particularly simple and inexpensive since it comprises a minimum of pieces. In addition, it may function in a large range of power.

What is claimed is:

1. An assembly forming an interfitting socket and plug for connection to a circuit in which the socket is mounted, without the circuit opening, wherein:

(a) the socket comprises:

(1) a body made of insulating material and provided with an outwardly open housing;

(2) a switch located in said housing near the bottom thereof and having two contact elements which are borne by conducting blades allowing series connection of the switch to the circuit through said body by being embedded in said insulating material, one of said blades having a rectilinear free end part projecting from said insulating material near the bottom of the housing and forming a substantially rectilinear elastic member bearing one of the contact elements so as to allow the return of the switch into position of closure by an elastic return force and to form a contact by pressure; and (3) two first branch contact elements integral with said conducting blades and projecting from said insulating material on two opposite side walls of the housing inside said housing; and (b) the plug comprises:

(1) a push element made of insulating material for opening the switch against said elastic return force when the plug is inserted into the outwardly open housing, said push element having a front end adapted for engagement with said elastic member which extends in a transverse direction with respect to the direction of insertion of the plug into the socket, and said push element having opposite side faces guided along said opposite walls of the housing, whereby the push element occupies virtually the whole width of the housing; and (2) two second branch contact elements located on said opposite side faces of the push element and borne by conducting blades allowing connection of said second branch contact elements to respective conductors through said push element by being embedded in the insulating material thereof, each second branch contact element coming into contact with a respective first branch contact element for a penetration of the plug less than that necessary for opening the switch, so that each pair constituted by a first branch contact element and a corresponding second branch contact element forms a sliding contact, said pressure type contact and said sliding type contacts lying substantially in a same plane parallel to said direction of insertion.

2. An assembly as claimed in claim 1, wherein the switch contact elements are located adjacent one of said side walls of the housing, the push element has a dissymmetrical form with said front end located near one of said side faces so as to come into contact with the elastic member near said one side wall of the housing and a shoulder is provided at the bottom of the housing near the side wall thereof opposite said one side wall so as form a stop cooperating with the front end of the push element to limit the insertion thereof and prevent the opening of the switch when the push element is turned with respect to its normal position.

3. The assembly of claim 2, wherein the contact elements of the switch are disposed in a lateral recess in the housing.

4. The assembly of claim 1, wherein the contact elements of the switch are pellets fixed to ends of the conducting blades.

5. The assembly of claim 1, wherein the conducting blades of the socket together form a U of which the lower part comprises the flexible member and the arm portions bear the first branch contact elements.

6. The assembly of claim 1, wherein the first branch contact elements are formed by bent parts of said conducting blades of the socket which project laterally into said housing.

7. The assembly of claim 1, wherein the second branch contact elements are subjected to a force tending to apply them towards the corresponding first branch contact elements to form contacts of the sliding and pressure type.

8. The assembly of claim 7, wherein the second branch contact elements are formed by bent parts of conductor blades which are disposed on either side of the push element and free ends of said blades are housed in grooves formed on the opposite side faces of the push element.

9. The assembly of claim 1, wherein notches are formed on the second branch contact elements on level with with the first branch contact elements when the plug is inserted in the housing.

* * * * *